US006042346A

United States Patent [19]

Doi

[11] Patent Number: 6,042,346

[45] Date of Patent: Mar. 28, 2000

[54] REFRIGERANT COMPRESSOR HAVING AN OPEN TYPE REFRIGERANT POOL AND AN OIL RESERVOIR

[75] Inventor: Yoshimasa Doi, Osaka, Japan

[73] Assignee: Daikin Industries, Ltd., Osaka, Japan

[21] Appl. No.: 08/860,272

[22] PCT Filed: Oct. 1, 1996

[86] PCT No.: PCT/JP96/02848

§ 371 Date: Jun. 17, 1997

§ 102(e) Date: Jun. 17, 1997

[87] PCT Pub. No.: WO97/14891

PCT Pub. Date: Apr. 24, 1997

[30] Foreign Application Priority Data

Oct. 17, 1995 [JP] Japan ..... 7-268386

[51] Int. Cl.[7] ..... F01C 1/02; F04B 39/02

[52] U.S. Cl. ..... 417/371; 418/55.6

[58] Field of Search ..... 417/371, 368; 418/55.1, 55.6

[56] References Cited

U.S. PATENT DOCUMENTS

| | | | |
|---|---|---|---|
| 4,033,707 | 7/1977 | Stutzman | 417/312 |
| 4,564,339 | 1/1986 | Nakamura et al. | 417/366 |
| 5,188,520 | 2/1993 | Nakamura et al. | 418/55.1 |
| 5,363,674 | 11/1994 | Powell | 62/505 |

FOREIGN PATENT DOCUMENTS

| | | | |
|---|---|---|---|
| 63-090695 | 4/1963 | Japan . | |
| 59-160089A | 9/1984 | Japan . | |
| 59-224493 | 12/1984 | Japan . | |
| 61-137890 | 8/1986 | Japan . | |
| 62-110593 | 7/1987 | Japan . | |
| 0239394 | 10/1988 | Japan | 417/371 |
| 0009979 | 1/1990 | Japan | 417/371 |
| 2-125986 | 5/1990 | Japan . | |
| 5-288172 | 11/1993 | Japan . | |

*Primary Examiner*—Charles G. Freay

*Attorney, Agent, or Firm*—Birch, Stewart, Kolasch & Birch, LLP

[57] ABSTRACT

There is provided a refrigerant compressor capable of satisfactorily ensuring a motor cooling effect, reducing inlet pressure loss and preventing the possible occurrence of dilution of oil when liquid refrigerant flows back, thereby allowing an improved lubrication. A partition is provided between an oil reservoir and a motor. The partition defines an upwardly opened type inhaled refrigerant pool for reserving liquid refrigerant inhaled from a suction pipe around the motor.

10 Claims, 7 Drawing Sheets

REFRIGERANT COMPRESSOR HAVING AN OPEN TYPE REFRIGERANT POOL AND AN OIL RESERVOIR

TECHNICAL FIELD

The present invention relates to so-called low-pressure dome type refrigerant compressors to be assembled into air conditioning systems and freezing systems, and in particular to those in which inhaled refrigerant is released inside its casing.

BACKGROUND ART

Conventionally, these kinds of low-pressure dome type refrigerant compressors include a compression element arranged in an upper position and a motor arranged in a lower position inside its casing that has an oil reservoir at its lower portion, and a suction pipe is opened inside the casing. In regard to a passage structure of gas refrigerant inhaled from the suction pipe, there are the types (A), (B) and (C) as follows.

(A) A suction pipe is opened oppositely to an outer surface of a lower portion of a stator of a motor inside a casing, and inhaled gas is guided from a gap around the periphery of the stator to a compression element side arranged in an upper position (refer to Japanese Utility Model Laid-Open Publication No. SHO 62-110593).

(B) A suction pipe is opened to a space above a motor inside a casing, and inhaled gas is guided to a compression element side by way of a short passage (refer to Japanese Patent Laid-Open Publication No. HEI 2-125986).

(C) A lower portion of a motor is covered with a cover, and a suction pipe is opened inside the cover, so that inhaled gas is guided to a compression element side through an air gap of the motor (refer to Japanese Patent Laid-Open Publication No. SHO 63-90695).

However, in the structure of the above (A), the inhaled gas is made to pass only through the peripheral portion of the motor, this causes a problem that an insufficient motor cooling effect results. Furthermore, when liquid refrigerant is inhaled together with inhaled gas, the liquid refrigerant passes through the peripheral portion of the stator to directly fall to an oil reservoir, and this causes a problem that it dilutes the oil and reduces the oil concentration to incur deficient lubrication.

In the structure of the above (B), there is almost no loss of pressure of the inhaled gas, however, cooling of the motor is insufficient. Thus, similar to the structure of (A), deficient lubrication by the liquid refrigerant occurs.

In the structure of the above (C), the motor cooling effect is satisfactory because the inhaled gas is made to pass through the air gap; however, suction pressure loss occurs. Furthermore, the liquid refrigerant can be reserved inside the cover, however, since its capacity is small, it cannot cope with, in particular, a liquid reflux of a multi-system having a plurality of indoor units or the like. Furthermore, once reserved liquid can be hardly discharged, and this may problematically cause an inoperable state of the apparatus.

Accordingly, it is an object of the present invention to provide a refrigerant compressor capable of satisfactorily ensuring a motor cooling effect, reducing suction pressure loss and preventing the possible occurrence of dilution of oil in the stage of liquid reflux, thereby allowing an improved lubricating performance to be achieved.

SUMMARY OF THE INVENTION

A refrigerant compressor of the present invention comprises: a casing forming an oil reservoir at its bottom portion; a compression element disposed in an upper position inside the casing; a motor which is disposed in a lower position inside the casing and drives the compression element; and a partition which is provided between the oil reservoir and the motor and defines an upwardly opened type inhaled refrigerant pool for reserving liquid refrigerant inhaled from a suction pipe around the motor.

According to the above invention, in the normal operating state, the gas refrigerant inhaled from the suction pipe can be once introduced into the inhaled refrigerant pool and then guided from the inhaled refrigerant pool to the compression element side through an air gap between a stator core and a rotor core of the motor. Therefore, the motor can be satisfactorily cooled by the inhaled gas refrigerant, and consequently, a range of operation can be expanded without sacrificing COP (coefficient of performance). Furthermore, when a liquid reflux occurs in a starting stage at a low temperature or in a similar case, the liquid refrigerant inhaled from the suction pipe can be reserved in the inhaled refrigerant pool defined by the partition and not in the oil reservoir. Therefore, the possible occurrence of dilution of oil in the oil reservoir because of the dissolution of the liquid refrigerant into the oil is prevented, so that the possible occurrence of deficient lubrication at sliding sections due to a reduction of oil concentration can be prevented, thereby allowing the reliability of the sliding sections to be improved. Furthermore, by preventing the dissolution of the liquid refrigerant into the oil by virtue of the inhaled refrigerant pool, the possible occurrence of bubble formation in the oil at a bearing gap of sliding sections is prevented, i.e., the possible occurrence of oil film breakage due to bubble formation in the refrigerant at the sliding sections can be prevented. Therefore, the possible occurrence of deficient lubrication at the sliding sections can be prevented to allow the lubricating performance to be improved.

In one embodiment, the partition has a closed end pipe-like configuration having a bottom wall for defining a lower inhaled refrigerant pool below the motor and a side wall for defining a peripheral inhaled refrigerant pool around the periphery of the motor.

According to the above construction, the partition is made to have the closed end pipe-like configuration having the bottom wall and the side wall. By the bottom wall and the side wall, the lower inhaled refrigerant pool is defined below the motor, while the peripheral inhaled refrigerant pool is defined around the periphery of the motor. With this arrangement, the total capacity of the inhaled refrigerant pool is increased by a simple construction by virtue of both the inhaled refrigerant pools to allow a great amount of liquid refrigerant to be reserved. Therefore, this arrangement can satisfactorily cope with a multi-system having a plurality of indoor units or the like in which a great liquid reflux rate is there. Furthermore, according to the above arrangement, in the normal operating state, a part of the inhaled gas refrigerant that is introduced from the suction pipe into the inhaled refrigerant pool is made to pass through an air gap between the stator core and the rotor core of the motor to the compression element side. Further, a remaining part of the inhaled gas refrigerant can be guided to the compression element side by way of the peripheral inhaled refrigerant pool. Therefore, the motor can be cooled more satisfactorily and effectively on both the inner and outer surfaces. Furthermore, by guiding the inhaled gas refrigerant introduced into the inhaled refrigerant pool not only through the air gap of the motor but also through the peripheral inhaled refrigerant pool to the compression element side, the inlet pressure loss can be reduced, and consequently, the range of operation can be satisfactorily expanded without sacrificing the COP.

In one embodiment, the side wall is made to have a height higher than that of the upper end of a stator core of the motor.

According to the above construction, since the height of the side wall of the partition is made higher than that of the upper end of the stator core of the motor, the total capacity of the inhaled refrigerant pool can be further increased by a simple construction to allow the arrangement to be more satisfactorily adapted to a multi-system having a plurality of indoor units or the like.

In one embodiment, the partition has a plate-like configuration having a traverse wall that transversely crosses inside the casing below the motor.

According to the above embodiment, since the partition has the plate-like configuration having the traverse wall that transversely crosses inside the casing below the motor, the intended purpose can be achieved while allowing the construction of the partition to be further simplified.

In one embodiment, the partition is provided with a lower side bearing for supporting a shaft of the motor.

According to the above embodiment, since the partition is provided with the lower side bearing for supporting the shaft of the motor, the intended purpose can be achieved without incurring the vibration of the motor shaft in the operating state.

In one embodiment, an opening of the suction pipe toward the inhaled refrigerant pool is made to front in a position that avoids a coil end of the motor.

According to the above embodiment, since the opening of the suction pipe toward the inhaled refrigerant pool is made to front in the position that avoids the coil end of the motor, dust such as metal powder that is included in the refrigerant can be prevented from sticking into the coil end of the motor and damaging an enamel coating film possibly occurring due to a leak accident or the like when the refrigerant is introduced from the suction pipe into the casing.

In one embodiment, an oil discharge pipe extending from an upper portion of the motor is opened below an upwardly opened end of the inhaled refrigerant pool.

According to the above embodiment, since the oil discharge pipe connected to the upper portion of the motor is opened below the upwardly opened end of the inhaled refrigerant pool, returning oil through lubrication at the sliding sections is prevented from being mixed with the inhaled gas refrigerant that is inhaled from the upper side of the motor to the compression element and is surely fed back to the oil reservoir side by way of the oil discharge pipe while reducing the amount of pickup of the returning oil by the inhaled gas refrigerant.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
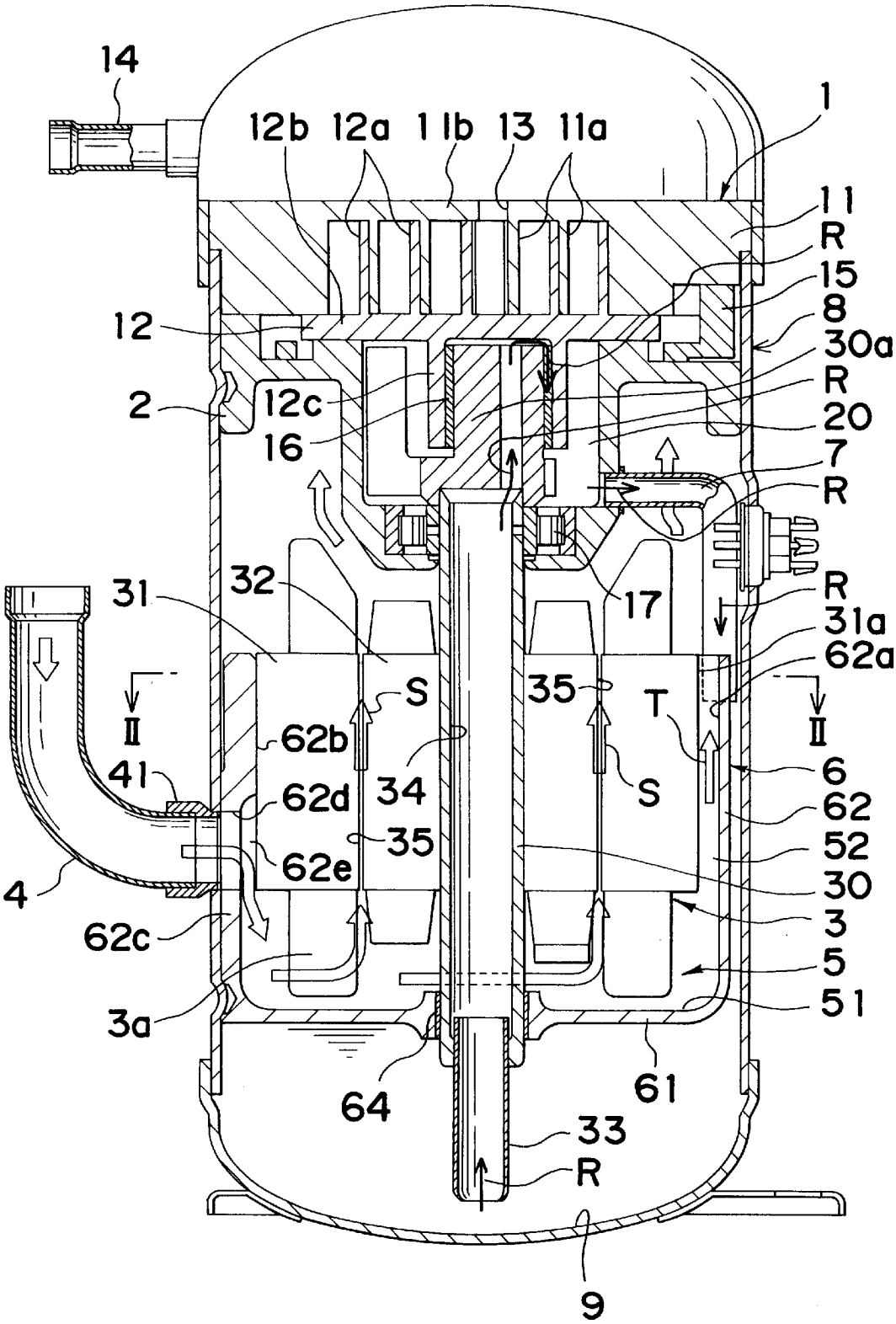
FIG. 1 is a longitudinal sectional view of a refrigerant compressor according to an embodiment of the present invention.

FIG. 1 shows a low-pressure dome type vertical scroll compressor provided as a preferred embodiment of a refrigerant compressor of the present invention. In this compressor, a compression element 1 is supported via a frame 2 in an upper position inside a hermetic casing 8, and a motor 3 is provided in a lower position inside the casing 8. The motor 3 has a stator core 31 and a rotor core 32, and a motor shaft 30 is connected to the rotor core 32. The compression element 1 has a fixed scroll 11 and a revolution scroll 12, add these scrolls 11 and 12 are supported on the frame 2 and vertically opposite to each other so that their scroll bodies 11*a* and 12*a* provided protrudingly from their flat plate sections 11*b* and 12*b* which are engaged with each other. It is to be noted that the frame 2 is press-fit in the casing 8 with a slight pressure and then caulked.

Further, a lower center portion of the revolution scroll 12 defines a pipe-like boss section 12*c* that protrudes into a crank chamber 20 provided at the frame 2. In this boss section 12*c* is inserted an eccentric section 30*a* provided integrally with an upper end of the motor shaft 30, so that the revolution scroll 12 is driven to revolve relative to the fixed scroll 11 via the eccentric section 30*a* in accordance with the rotation of the motor 3. By the revolution of the revolution scroll 12, a gas refrigerant introduced from a suction pipe 4 that is opening inside the casing 8 is compressed in a compression chamber between the scroll bodies 11*a* and 12*a*, and the compressed gas refrigerant is introduced from a discharge outlet 13 formed at the fixed scroll 11 into a high-pressure space in an upper position inside the casing 8 and then taken out to the outside via an outer discharge pipe 14 that is opened to the space. It is to be noted that a reference numeral 15 denotes an Oldham ring interposed between both the scrolls 11 and 12.

Further, there is provided at the lower side of the motor shaft 30 an oil pickup device 33 that faces a bottom oil reservoir 9 of the casing 8. As indicated by black arrows R in FIG. 1, the oil pumped up from the oil reservoir 9 by the device 33 is supplied via an oil passage 34 formed through the motor shaft 30 and the eccentric section 30*a* to a bearing metal 16 interposed between the eccentric section 30*a* and the pipe-like boss section 12*b*, an upper bearing 17 that supports the upper portion of the motor shaft 30 on the frame 2 and the like, and the oil that has been used for lubrication is fed back from the crank chamber 20 to the oil reservoir 9.

Figure 2:
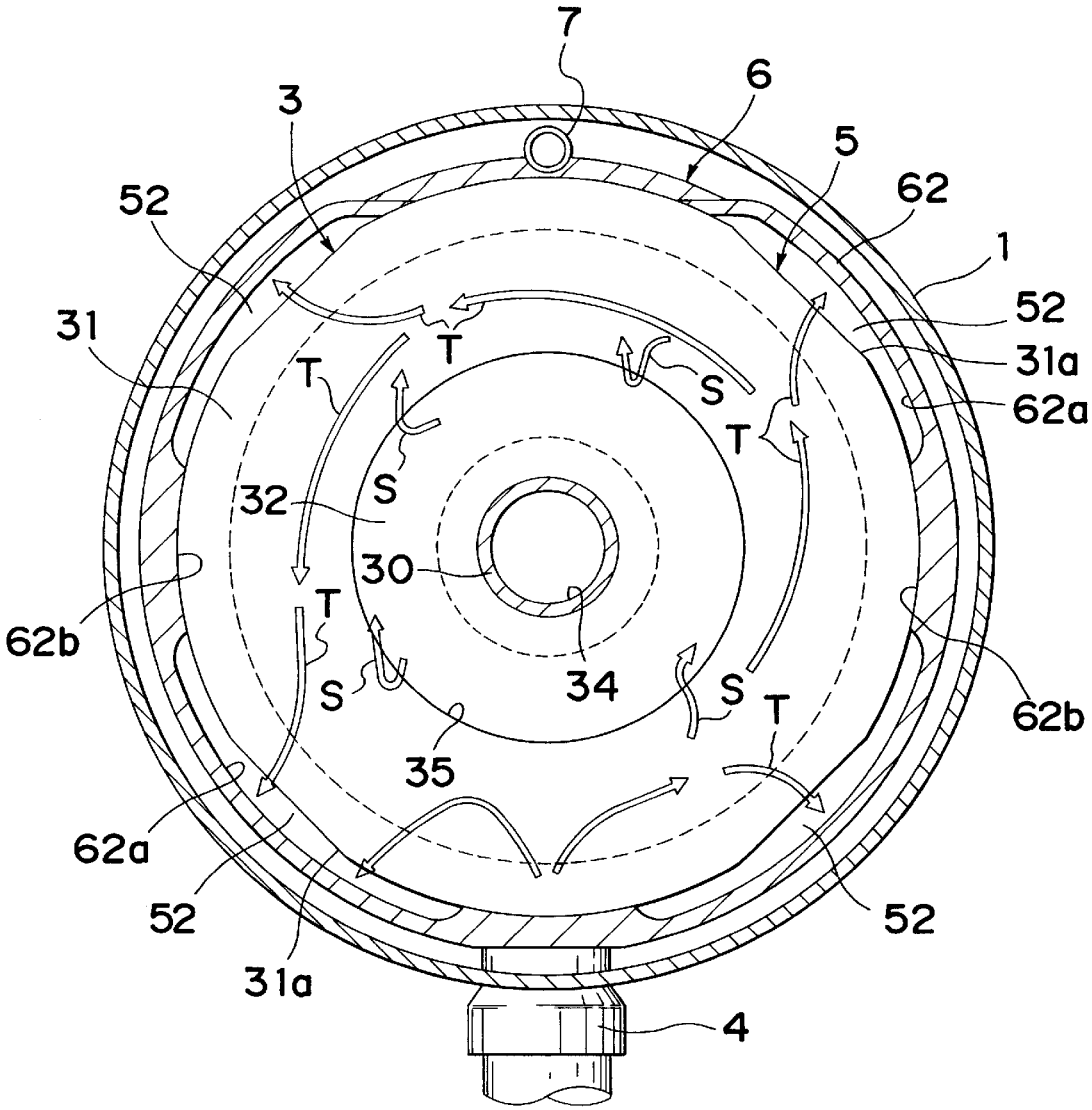
FIG. 2 is a sectional view taken along a line II—II in FIG. 1.

In addition to the above, a partition 6 that defines an upwardly opened type inhaled refrigerant pool 5 for reserving the liquid refrigerant inhaled from the suction pipe 4 separately from the oil in the oil reservoir 9 is provided around the motor 3 in a lower position inside the casing 8. As shown in FIGS. 1 through 4, the partition 6 has a closed end pipe-like shape having a bottom wall 61 and a pipe-like side wall 62 that stands upwardly from the periphery of the bottom wall 61 while defining a lower inhaled refrigerant pool 51 between the bottom wall 61 and the lower portion of the motor 3. The bottom wall 61 and the side wall 62 are integrated. Further, as shown in FIGS. 1 and 2, a plurality of recess sections 62*a* upwardly opened are provided in the vertical direction on the inner surface of the side wall 62, thereby forming a plurality of peripheral inhaled refrigerant pools 52 opened upwardly between the recess sections 62*a* and core cuts 31*a* provided at a portion of the periphery of the stator core 31. The bottom wall 61 is provided with a lower side bearing 64 that rotatably supports the motor shaft 30.

Figure 3:
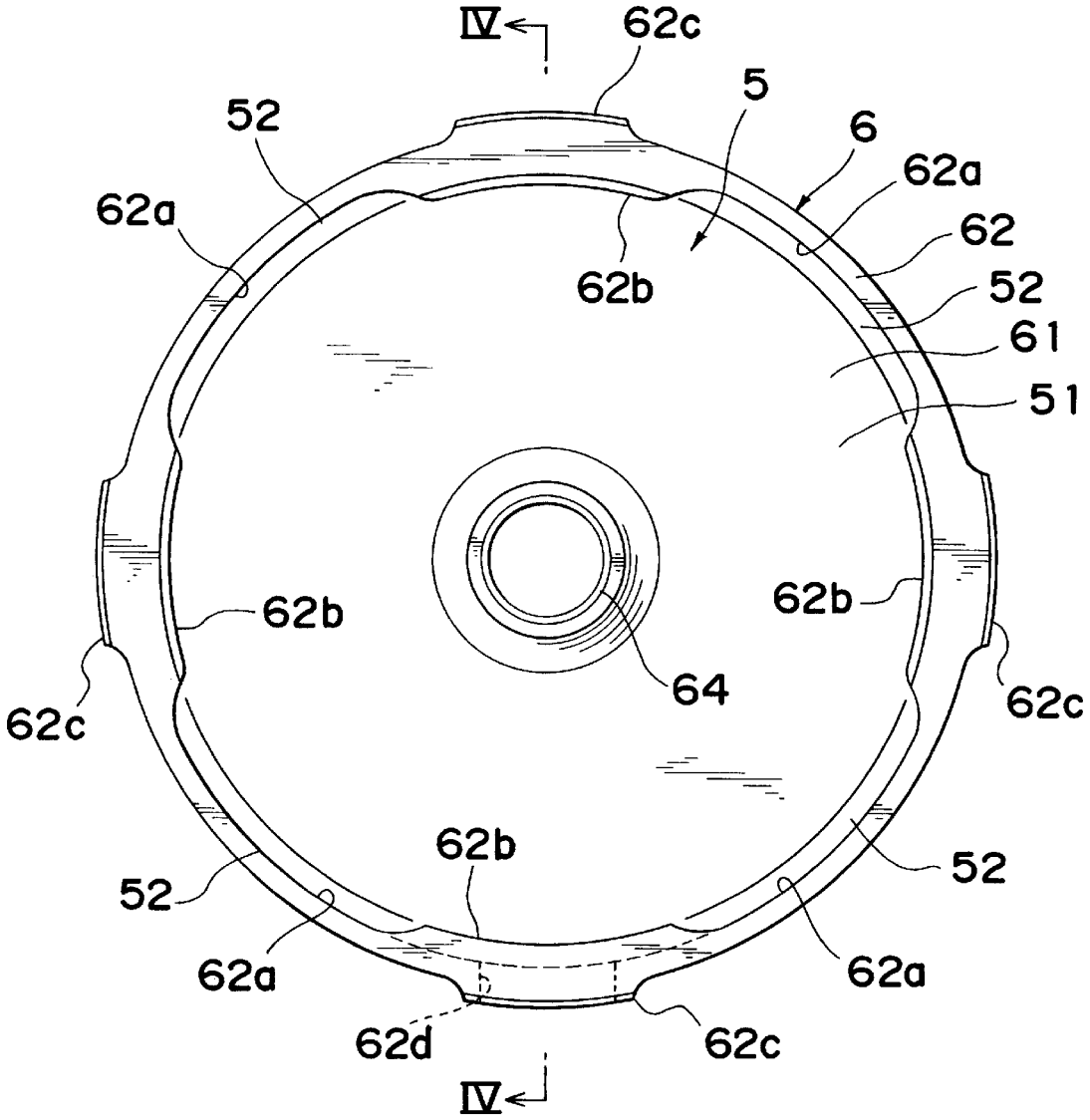
FIG. 3 is a plan view of a partition.

Further, a plurality of first press-in interferences 62*b* that expand inwardly are formed at the inner peripheral upper side of the side wall 62 of the partition 6 except for the recess sections 62*a*, so that the stator core 31 is integrally fixed to the side wall 62 by being press-fit via the press-in interferences 62*b* while ensuring the peripheral inhaled refrigerant pool 52 between them. Further, as shown in FIGS. 1 and 3, below portions that belong to the periphery of the side wall 62 and are opposite from the first press-in interferences 62*b* are formed second press-in interferences 62*c* that expand outwardly. By inserting the second press-in interferences 62*c* with a slight pressure into the inner wall surface of the casing 8 and caulking the same, the whole partition 6 is integrated with the casing 8.

Figure 4:
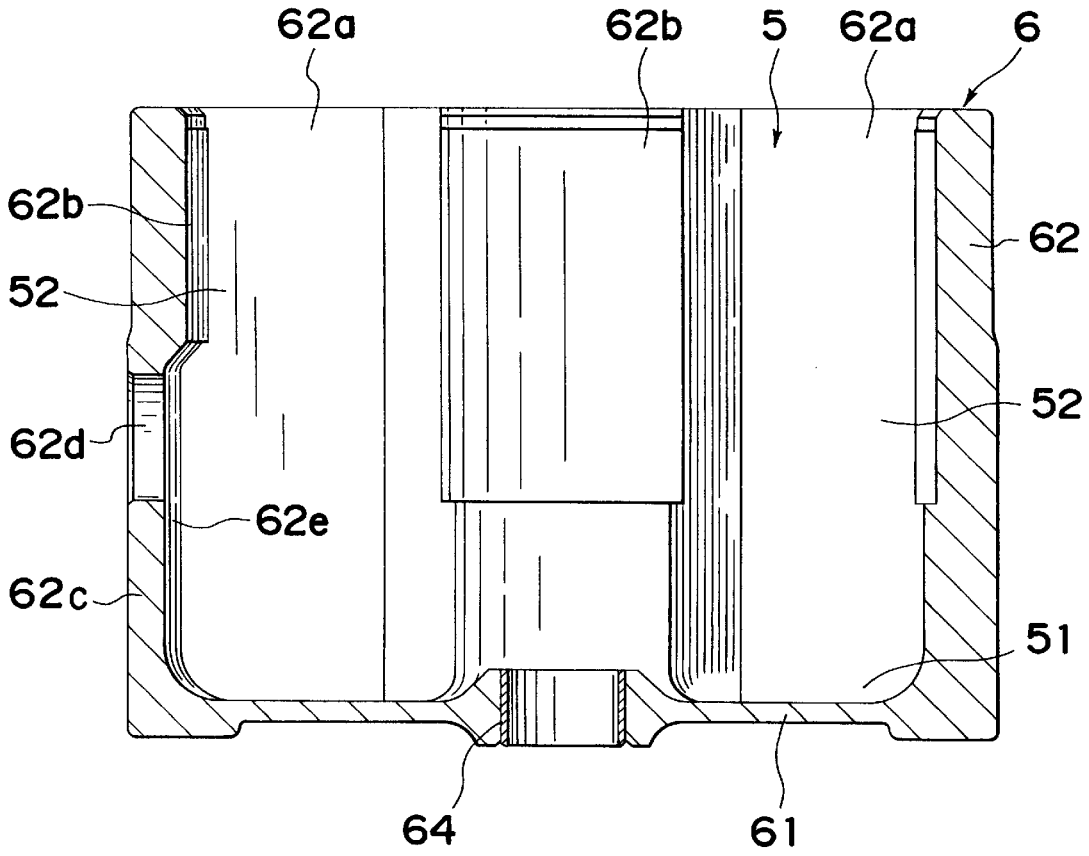
FIG. 4 is a sectional view taken along a line IV—IV in FIG. 3.

Further, as shown in FIGS. 1 and 4, an opening section 62*d* for the suction pipe 4 is formed in a portion which is located below the first press-in interferences 62*b* of the side wall 62 and in which the second press-in interference 62*c* is formed, and the suction pipe 4 is connected to the opening section 62*d* via a pipe joint 41. In addition, a guide passage 62*e* for guiding the refrigerant gas introduced from the suction pipe 4 to the lower inhaled refrigerant pool 51 and the peripheral inhaled refrigerant pool 52 is formed around the periphery of the opening section 62*d* on the inner wall surface of the side wall 62.

Then, in the normal operating state, as indicated by void arrows in FIGS. 1 and 2, the gas refrigerant inhaled from the suction pipe 4 is guided via the opening section 62*d* of the side wall 62 and the guide passage 62*e* to the lower inhaled refrigerant pool 51. Further, as indicated by void arrows S, a part of the gas refrigerant that has reached the lower inhaled refrigerant pool 51 is made to pass through an air gap 35 between the stator core 31 and the rotor core 32 of the motor 3. Further, as indicated by a void arrow T, the remaining gas refrigerant is made to pass through the peripheral inhaled refrigerant pool 52 defined between the stator core 31 and the side wall 62 and then guided to the compression element 1 side. Thus, by the gas refrigerant that passes through the peripheral inhaled refrigerant pool 52 and the air gap 33, the motor 3 can be wholly cooled satisfactorily and effectively on the inner and outer peripheral surfaces, and by further guiding the gas refrigerant inhaled from the suction pipe 4 to the compression element 1 side by way of the above two passages, the inlet pressure loss can be also reduced.

In this case, the opening section 62*d* for the suction pipe 4 is provided at the portion where the second press-in interference 62*c* is formed, so that the refrigerant gas that has reached the opening section 62*d* can be prevented from leaking vertically through between the outer wall surface of the side wall 62 and the inner wall surface of the casing 8 by the second press-in interference 62*c*. Furthermore, the guide passage 62*e* is provided below the first press-in interference 62*b*, so that the refrigerant gas that has reached the guide passage 62*e* from the opening section 62*d* can be prevented from leaking upwardly between the inner wall surface of the side wall 62 and the outer wall surface of the stator core 31 by the first press-in interference 62*b*. Therefore, the gas refrigerant introduced from the suction pipe 4 can be surely guided from the opening section 62*d* and the guide passage 62*e* to both the inhaled refrigerant pools 51 and 52.

On the other hand, when a liquid reflux occurs at the time of starting at a low room temperature or in a similar case, the liquid refrigerant inhaled from the suction pipe 4 is reserved in the inhaled refrigerant pool 5 that is defined by the partition 6 with respect to the oil reservoir 9 and has an increased volume by virtue of the lower inhaled refrigerant pool 51 and the peripheral inhaled refrigerant pool 52. Therefore, the possible occurrence of dilution of oil in the oil reservoir 9 due to the dissolution of the liquid refrigerant into the oil is prevented, so that the possible deficient lubrication to the bearing metal 16, the upper bearing 17 and the like due to the reduction of oil concentration can be prevented. Furthermore, the possible occurrence of bubble formation in the oil at the bearing metal 16, the upper bearing 17 and the like is prevented, i.e., the possible occurrence of oil film breakage due to bubble formation in the refrigerant is prevented, so that the possible occurrence of deficient lubrication to the bearing metal 16, the upper bearing 17 and the like is prevented to allow the lubricating performance to be improved.

Furthermore, when liquid refrigerant greater in amount than the capacity of the inhaled refrigerant pool 5 is introduced from the suction pipe 4, the liquid refrigerant overflows the inhaled refrigerant pool 5 to try to enter the oil reservoir 9 through a gap between the side wall 62 of the partition 6 that defines the inhaled refrigerant pool 5 and the inner wall of the hermetic casing 8. However, since the internal temperature of the casing 8 is gradually increased in accordance with the operation after start and consequently the liquid refrigerant is gasified, the liquid refrigerant scarcely overflows the inhaled refrigerant pool 5. Even when the overflow occurs, the liquid refrigerant scarcely dissolves into the oil having an elevated temperature, and therefore, an excessive dissolution of the liquid refrigerant into the oil can be prevented.

In the above embodiment, in order to achieve the intended purpose without incurring the vibration of the shaft 30 connected to the motor 3 in the operating stage, the lower side bearing 64 comprised of a bearing metal is provided in the center portion of the bottom wall 61 of the partition 6, and the shaft 30 is supported at both its upper and lower portions by the lower side bearing 64 and the upper side bearing 17.

Furthermore, in the above embodiment, in order to prevent dust such as metal powder that is included in the refrigerant from sticking into a coil end 3*a* of the motor 3 and damaging an enamel coating film incurring leak accident or the like when the refrigerant is introduced from the suction pipe 4 into the hermetic casing 8, the opening section 62*d* of the side wall 62 and the guide passage 62*e* are made to front in a position that avoids the coil end 3*a* of the motor 3.

Furthermore, in the above embodiment, in order to prevent the reflux oil obtained through lubrication at the bearing metal 16, the upper bearing 17 and the like from being mixed with the inhaled gas refrigerant that is inhaled from the upper side of the motor 3 to the compression element 1 and to allow the ref lux oil to be surely fed back to the oil reservoir 9 side by way of an oil discharge pipe 7 while reducing the amount of pickup of the reflux oil by the inhaled gas refrigerant, the oil discharge pipe 7 is connected to the crank chamber 20. The lower end of the oil discharge pipe 7 is made to open at the gap between the side wall 62 of the partition 6 and the casing 8 just below the upwardly opened end of the inhaled refrigerant pool 5, so that the reflux oil from the crank chamber 20 is fed back from the lower end of the oil discharge pipe 7 via the gap into the oil reservoir 9.

Figure 5:
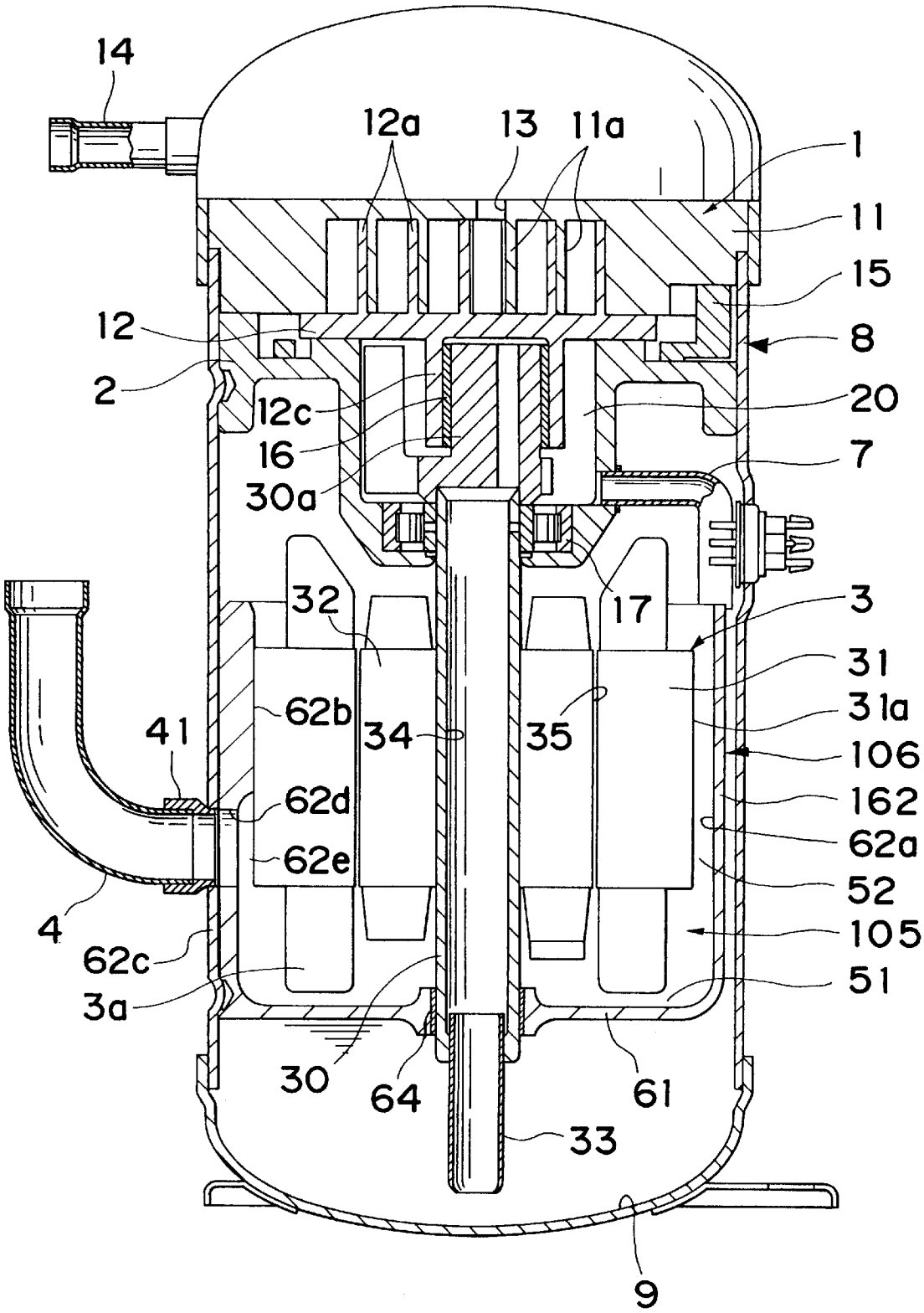
FIG. 5 is a longitudinal sectional view showing another embodiment.
Figure 6:
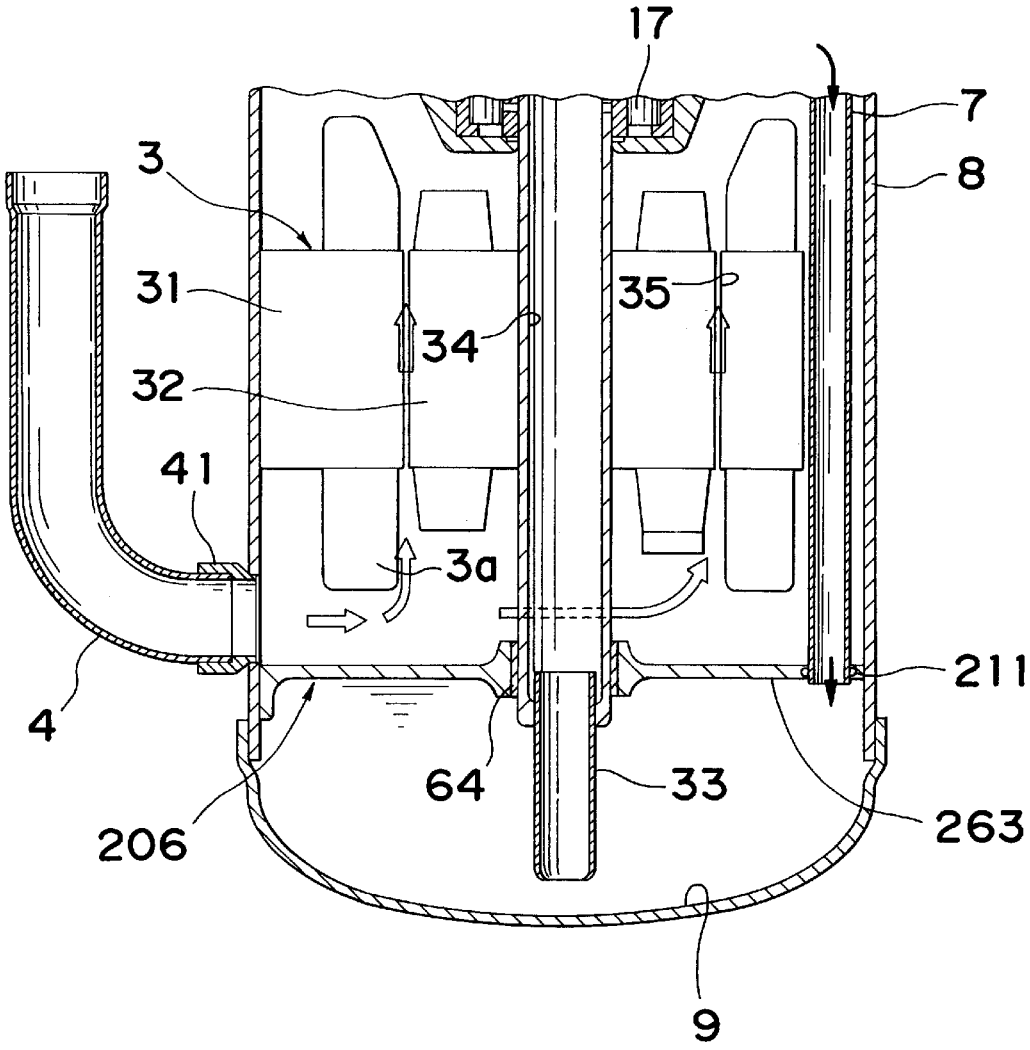
FIG. 6 is a longitudinal sectional view showing another embodiment.
Figure 7:
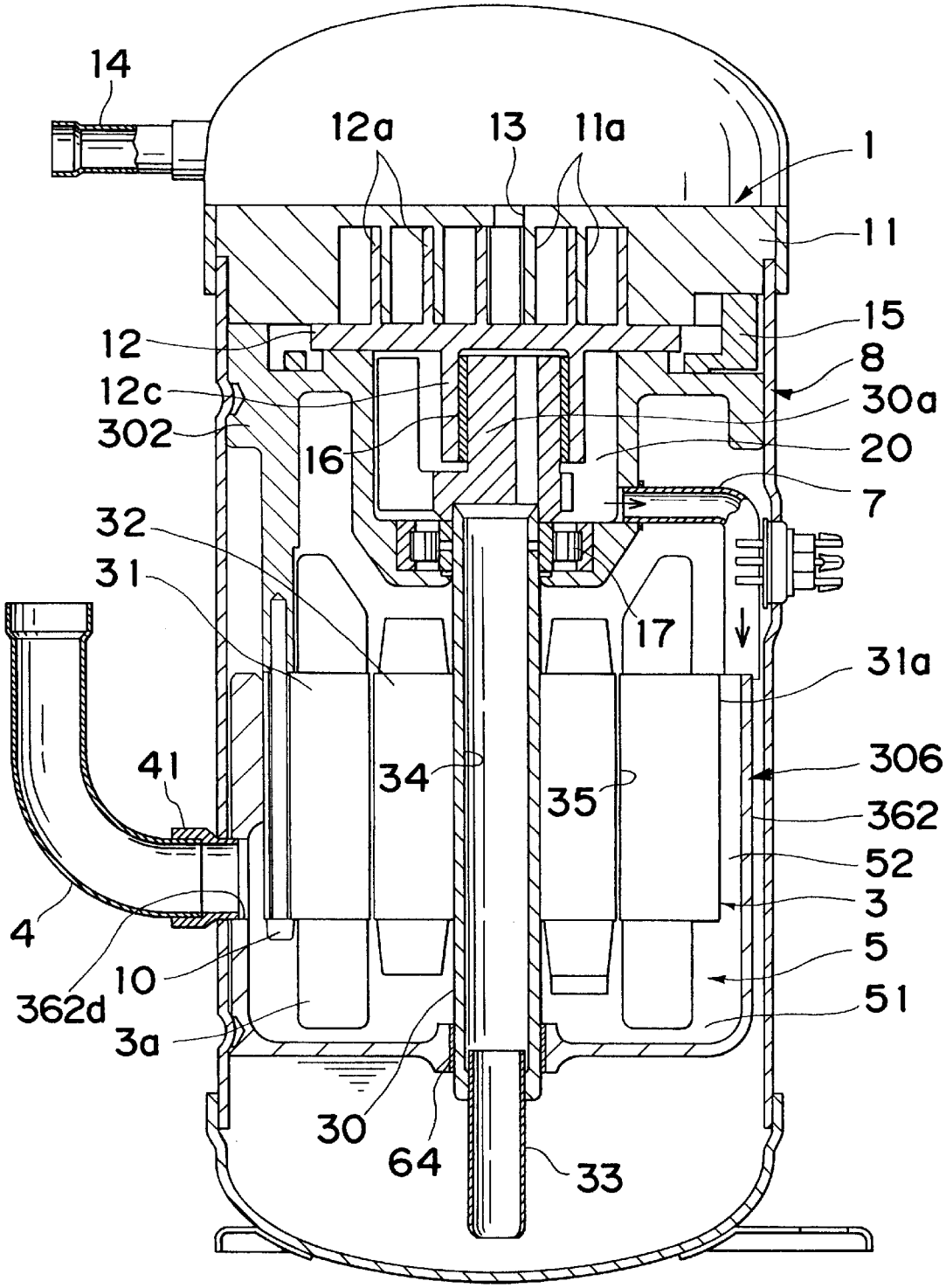
FIG. 7 is a longitudinal sectional view showing another embodiment.

FIGS. 5, 6 and 7 show other embodiments. In describing these embodiments, the same components as those of the embodiment shown in FIG. 1 are denoted by the same reference numerals with no description provided therefor, and only the different points will be described below.

In the embodiment shown in FIG. 5, in order to further increase the total capacity of an inhaled refrigerant pool 105 by a simple construction to allow the compressor to be able to more satisfactorily cope with a multi-system having a plurality of indoor units or the like, a side wall 162 of a partition 106 is made to have a height higher than that of the upper end of the stator core 31 of the motor 3.

Furthermore, in the embodiment shown in FIG. 6, in order to achieve the intended purpose by further simplifying the structure of the partitions 6 and 106, a partition 206 is placed below the motor 3 and made to have a circular plate shape having a cross wall 263 that transversely crosses the hermetic casing 8 below the motor 3.

Furthermore, when a lower portion of the oil discharge pipe 7 is supported via an O-ring 211 at a bottom wall 263 of the partition 206 and the end of the oil discharge pipe 7 is made to open at the oil reservoir 9 defined adjacently to the bottom wall 263, the reflux oil from the crank chamber 20 (refer to FIG. 1) can be surely and satisfactorily fed back directly into the oil reservoir 9.

Furthermore, the embodiment shown in FIG. 7 has an alignment process accuracy alleviated further than in the embodiments shown in FIGS. 1 through 4. In the embodiments shown in FIGS. 1 through 4, the first and second press-in interferences 62*b* and 62*c* are formed on the inner and outer surfaces of the side wall 62 of the partition 6, and the partition 6 is press-fit into the hermetic casing 8 via the press-in interferences 62*b* and 62*c* and fixed. In this case, the casing 8 and the partition 6 are required to be subject to an accurate aligning process, and this increases the cost and worsens the workability of assembling.

Therefore, in the embodiment shown in FIG. 7, in order to firmly integrate a partition 306 with the inside of the hermetic casing 8 without requiring an accurate aligning process, the whole partition 306 is made to have a size that allows itself to be inserted into the hermetic casing 8, and its side wall 362 is suspended in midair via a plurality of setscrews 10 inserted in the stator core 31 with the stator core 31 press-fit in the side wall 362 of the partition 306. In the present case, a gap is generated between the inner wall of the hermetic casing 8 and the outer surface of the side wall 362, and therefore, the end of a pipe joint 41 is inserted inwardly of an opening 362*d* formed at the side wall 362, so that gas refrigerant inhaled from the suction pipe 4 can be prevented from leaking through the gap.

Industrial Applicability

The refrigerant compressor of the present invention is used in an air conditioner, a refrigerant apparatus or the like.

What is claimed is:

1. A refrigerator compressor comprising:

a casing forming an oil reservoir at its bottom portion;

a compression element disposed in an upper position inside the casing;

a motor which is disposed in a lower position inside the casing and drives the compression element;

a partition wall defined on only one side of the motor and between the oil reservoir and the motor, said partition wall being liquid-tight and defining an upwardly opened type inhaled refrigerant pool for reserving liquid refrigerant inhaled from a suction pipe around the motor; and an oil discharge passage for returning oil in the upper position of the casing to the oil reservoir so as not to mix the oil with the inhaled liquid refrigerant in the inhaled refrigerant pool.

2. The refrigerant compressor as claimed in claim 1, wherein the partition wall has a closed end pipe-like configuration having a bottom wall for defining a lower inhaled refrigerant pool below the motor and a side wall for defining a peripheral inhaled refrigerant pool around the periphery of the motor, and a clearance is provided between the side wall of the partition wall and the casing so as to define the oil discharge passage.

3. The refrigerant compressor as claimed in claim 2, wherein the side wall is made to have a height higher that that of an upper end of a stator core of the motor.

4. The refrigerant compressor as claimed in claim 1, wherein the partition wall has a plate-like configuration having a traverse wall that transversely crosses inside the casing below the motor.

5. The refrigerant compressor as claimed in claim 1, wherein the partition wall is provided with a lower side bearing for supporting a shaft of the motor.

6. The refrigerant compressor as claimed in claim 1, wherein an opening of the suction pipe toward the inhaled refrigerant pool is made to front in a position that avoids a coil end of the motor.

7. The refrigerant compressor as claimed in claim 1, wherein said oil discharge pipe extending from an upper portion of the motor is opened below an upwardly opened end of the inhaled refrigerant pool.

8. The refrigerant compressor as claimed in claim 1, wherein the partition wall is defined upwardly only on a side of the casing opposite the suction pipe.

9. The refrigerant compressor as claimed in claim 1, wherein the suction pipe is positioned adjacent a lateral side of the motor.

10. The refrigerant compressor as claimed in claim 1, wherein the partition wall defines a space between the motor and the casing, wherein the space extends along at least a portion of a vertical part of the casing.

* * * * *